US010245611B2

(12) United States Patent
Li et al.

(10) Patent No.: US 10,245,611 B2
(45) **Date of Patent: *Apr. 2, 2019**

(54) SLURRY DISTRIBUTION SYSTEM AND METHOD

(71) Applicant: United States Gypsum Company, Chicago, IL (US)

(72) Inventors: Alfred C. Li, Naperville, IL (US); Christopher C. Lee, Deerfield, IL (US); Christopher Nelson, Lindenhurst, IL (US); Cesar Chan, Libertyville, IL (US); James Wittbold, Des Plaines, IL (US); Weixin D. Song, Shanghai (CN)

(73) Assignee: United States Gypsum Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/445,794

(22) Filed: Feb. 28, 2017

(65) Prior Publication Data

US 2017/0165704 A1 Jun. 15, 2017

Related U.S. Application Data

(63) Continuation of application No. 13/341,016, filed on Dec. 30, 2011, now Pat. No. 9,579,822.
(Continued)

(51) Int. Cl.
*B05B 1/00* (2006.01)
*B28B 19/00* (2006.01)
(Continued)

(52) U.S. Cl.
CPC ..... *B05C 5/0254* (2013.01); *B05C 5/0262* (2013.01); *B05C 11/10* (2013.01); *B05D 1/28* (2013.01); *B28B 19/0092* (2013.01)

(58) Field of Classification Search
CPC . B28B 19/0092; B05C 5/0254; B05C 5/0262; B05C 11/10; B05D 1/28
(Continued)

(56) References Cited

U.S. PATENT DOCUMENTS 1,452,702 A 4/1923 Pipe
2,097,613 A 11/1937 Batcheller
(Continued)

FOREIGN PATENT DOCUMENTS

AT 402826 B 7/1997
CN 1954166 A 4/2007
(Continued)

OTHER PUBLICATIONS

Burrows, "A Decade's Experience of Gypsum Board Weight Reduction in the U.S.", 14. Internationale Baustofftagung (Weimar, Sep. 20-23, 2000), 1.0197-1.0207.
(Continued)

*Primary Examiner* — Davis Hwu
(74) *Attorney, Agent, or Firm* — Leydig, Voit & Mayer, Ltd.; Philip T. Petti; Pradip K. Sahu

(57) ABSTRACT

A slurry distributor for use in a continuous manufacturing process includes an inlet opening and a shaped duct adapted to receive a flow of slurry provided at the inlet opening. The shaped duct has a parabolic guide surface adapted to redirect the flow of slurry. An outlet opening in fluid communication with the shaped duct is adapted to discharge the flow of slurry from the slurry distributor.

15 Claims, 5 Drawing Sheets

Related U.S. Application Data

(60) Provisional application No. 61/550,827, filed on Oct. 24, 2011, provisional application No. 61/428,736, filed on Dec. 30, 2010, provisional application No. 61/428,706, filed on Dec. 30, 2010.

(51) Int. Cl.
*B05C 5/02* (2006.01)
*B05C 11/10* (2006.01)
*B05D 1/28* (2006.01)

(58) Field of Classification Search
USPC ..... 239/559
See application file for complete search history.

(56) References Cited

U.S. PATENT DOCUMENTS 2,203,072 A 6/1940 Albright
2,660,416 A 11/1953 Camp et al.
2,700,622 A 1/1955 Burwell
2,882,716 A 4/1959 Anderson
2,998,198 A 8/1961 Young
3,053,314 A 9/1962 McGillis et al.
3,083,756 A 4/1963 Page et al.
3,196,864 A 7/1965 Wallace
3,198,867 A 8/1965 Siggers
3,266,974 A 8/1966 Staver
3,296,346 A 1/1967 Shannon
3,297,601 A 1/1967 Ptasieaski et al.
3,359,146 A 12/1967 Lane et al.
3,363,769 A 1/1968 Wilmot et al.
3,380,333 A 4/1968 Clay et al.
3,400,190 A 9/1968 Donald
3,415,920 A 12/1968 Lee et al.
3,432,588 A 3/1969 Breidt et al.
3,437,172 A 4/1969 Allen
3,458,907 A 8/1969 Shannon
3,459,620 A 8/1969 McCleary et al.
3,467,281 A 9/1969 Archer
3,494,993 A 2/1970 Breidt et al.
3,532,781 A 10/1970 Shannon
3,558,380 A 1/1971 Pook
3,583,681 A 6/1971 Brown
3,602,405 A 8/1971 Ames
3,644,169 A 2/1972 Phillips
3,663,562 A 5/1972 Magerlein et al.
3,740,027 A 6/1973 Kormos
3,760,036 A 9/1973 Matthews
3,781,320 A 12/1973 Irwin
3,795,259 A 3/1974 Brandin et al.
3,841,530 A 10/1974 Janninck
3,909,170 A 9/1975 Riboulet et al.
3,959,431 A 5/1976 Nissel
3,959,432 A 5/1976 Wiley
4,110,061 A 8/1978 Gerritsen
4,113,829 A 9/1978 Bowker et al.
4,153,403 A 5/1979 Schneider
4,175,591 A 11/1979 Welker
4,181,647 A 1/1980 Beach
4,187,275 A 2/1980 Bracalielly et al.
4,190,144 A 2/1980 Lybbert
4,268,236 A 5/1981 Peille et al.
4,279,673 A 7/1981 White et al.
4,288,263 A 9/1981 Delcoigne et al.
4,334,786 A 6/1982 Delcoigne et al.
4,354,885 A 10/1982 White
4,361,254 A 11/1982 Teraoku et al.
4,364,790 A 12/1982 Delcoigne et al.
4,392,613 A 7/1983 Graff et al.
4,474,477 A 10/1984 Smith et al.
4,533,300 A 8/1985 Westerlund et al.
4,557,261 A 12/1985 Rugheimer
4,588,299 A 5/1986 Brown et al.
4,618,294 A 10/1986 Brown
4,664,611 A 5/1987 Kumar
4,758,261 A 7/1988 Parker et al.
4,819,878 A 4/1989 Bailey et al.
4,827,921 A 5/1989 Rugheimer
4,934,596 A 6/1990 Hilton et al.
4,942,003 A 7/1990 Bold
5,188,455 A 2/1993 Hammerstedt
1,905,733 A 4/1993 Moore
5,211,511 A 5/1993 Deal, Jr.
5,211,965 A 5/1993 Kitagawa
5,261,485 A 11/1993 Thornton et al.
5,316,703 A 5/1994 Schrenk
5,320,677 A 6/1994 Baig
5,350,290 A 9/1994 Honings
5,386,943 A 2/1995 Peeters
5,395,653 A 3/1995 Baum
5,508,072 A 4/1996 Andersen et al.
5,520,779 A 5/1996 Bold
5,580,409 A 12/1996 Andersen et al.
5,582,670 A 12/1996 Andersen et al.
5,622,729 A 4/1997 Mower
5,643,510 A 7/1997 Sucech
5,660,903 A 8/1997 Andersen et al.
5,660,904 A 8/1997 Andersen et al.
5,665,442 A 9/1997 Andersen et al.
5,679,381 A 10/1997 Andersen et al.
5,683,635 A 11/1997 Sucech et al.
5,709,593 A 1/1998 Guthrie et al.
5,714,001 A 2/1998 Savoly et al.
5,718,797 A 2/1998 Phillips et al.
5,720,913 A 2/1998 Andersen et al.
5,730,819 A 3/1998 Retti
5,766,525 A 6/1998 Andersen et al.
5,792,322 A 8/1998 Hergert et al.
5,794,642 A 8/1998 Zikeli et al.
5,800,647 A 9/1998 Andersen et al.
5,844,051 A 12/1998 Onzuka et al.
5,879,486 A 3/1999 Philips et al.
5,879,722 A 3/1999 Andersen et al.
5,908,240 A 6/1999 Hood et al.
5,972,426 A 10/1999 Kutsuzawa et al.
5,997,691 A 12/1999 Gautam et al.
6,057,000 A 5/2000 Cai
6,059,444 A 5/2000 Johnson et al.
6,123,445 A 9/2000 Grassi
6,153,040 A 11/2000 Rohlf et al.
6,154,947 A 12/2000 Koebbe
6,176,036 B1 1/2001 Pease
6,276,946 B1 8/2001 Stephan
6,286,422 B1 9/2001 Lin et al.
6,323,159 B1 11/2001 Raza
6,340,123 B1 1/2002 Lee et al.
6,342,284 B1 1/2002 Yu et al.
6,363,967 B1 4/2002 Tanaka et al.
6,382,922 B1 5/2002 Lewis et al.
6,402,062 B1 6/2002 Bendig et al.
6,409,823 B1 6/2002 Shake et al.
6,416,695 B1 7/2002 Miller
6,427,877 B1 8/2002 Trout
6,471,799 B1 10/2002 Sasaki et al.
6,494,609 B1 12/2002 Wittbold et al.
6,524,388 B1 2/2003 Yamada et al.
6,616,985 B2 9/2003 Powell et al.
6,632,550 B1 10/2003 Yu et al.
6,645,483 B2 11/2003 McGhee
6,699,364 B2 3/2004 Song et al.
6,699,426 B1 3/2004 Burke
6,752,895 B1 6/2004 Song et al.
6,774,146 B2 8/2004 Savoly et al.
6,800,131 B2 10/2004 Yu et al.
6,872,280 B2 3/2005 Tanaka et al.
6,874,930 B2 4/2005 Wittbold et al.
6,878,321 B2 4/2005 Hauber et al.
7,007,914 B2 3/2006 Petersen et al.
7,127,865 B2 10/2006 Douglas
6,991,361 B2 12/2006 Flood
7,160,389 B2 1/2007 Gibson et al.
7,172,403 B2 2/2007 Burke
7,255,123 B2 8/2007 Cedergaard et al.

(56) References Cited

U.S. PATENT DOCUMENTS

| | | | |
|---|---|---|---|
| 7,296,919 | B2 | 11/2007 | Petersen et al. |
| 7,364,676 | B2 | 4/2008 | Sucech |
| 7,458,532 | B2 | 12/2008 | Sloan |
| 7,475,599 | B2 | 1/2009 | Frank et al. |
| 7,588,634 | B2 | 9/2009 | Lynn et al. |
| 7,690,834 | B2 | 4/2010 | Nakamura et al. |
| 7,718,019 | B2 | 5/2010 | Wittbold et al. |
| 7,731,794 | B2 | 6/2010 | Yu et al. |
| 7,736,720 | B2 | 6/2010 | Yu et al. |
| 7,771,851 | B2 | 8/2010 | Song et al. |
| 7,875,114 | B2 | 1/2011 | Wittbold et al. |
| 7,875,192 | B2 | 1/2011 | Eigenmann et al. |
| 7,980,922 | B2 | 7/2011 | Kiesel et al. |
| 8,016,960 | B2 | 9/2011 | Wittbold et al. |
| 8,030,377 | B2 | 10/2011 | Dubey et al. |
| 8,038,790 | B1 | 10/2011 | Dubey et al. |
| 8,057,915 | B2 | 11/2011 | Song et al. |
| 8,062,741 | B2 | 11/2011 | Tonyan et al. |
| 8,088,218 | B2 | 1/2012 | Blackburn et al. |
| 8,119,207 | B2 | 2/2012 | Rigaudon et al. |
| 8,128,126 | B2 | 3/2012 | Poupore et al. |
| 8,142,859 | B2 | 3/2012 | Domey et al. |
| 8,142,915 | B2 | 3/2012 | Blackburn et al. |
| 8,177,541 | B2 | 5/2012 | Fahey |
| 8,197,952 | B2 | 6/2012 | Yu et al. |
| 8,257,489 | B2 | 9/2012 | Yu et al. |
| 8,360,825 | B2 | 1/2013 | Hsu et al. |
| 8,444,787 | B2 | 5/2013 | Wittbold et al. |
| 8,475,762 | B2 | 7/2013 | Li et al. |
| 8,597,426 | B2 | 12/2013 | Lee et al. |
| 8,685,188 | B2 | 4/2014 | Yamaji et al. |
| 8,801,852 | B2 | 8/2014 | Lee et al. |
| 2002/0045074 | A1 | 4/2002 | Yu et al. |
| 2002/0056690 | A1 | 5/2002 | Wegner |
| 2003/0049450 | A1 | 3/2003 | Song et al. |
| 2003/0068959 | A1 | 4/2003 | Kajiwara et al. |
| 2003/0117891 | A1 | 6/2003 | Wittbold et al. |
| 2003/0200714 | A1 | 10/2003 | Minke et al. |
| 2004/0033314 | A1 | 2/2004 | Rao et al. |
| 2004/0033324 | A1 | 2/2004 | Meyer |
| 2004/0091406 | A1 | 5/2004 | Wolfert et al. |
| 2004/0231916 | A1 | 11/2004 | Englert et al. |
| 2005/0019618 | A1 | 1/2005 | Yu et al. |
| 2005/0103347 | A1 | 5/2005 | Curti et al. |
| 2005/0253098 | A1 | 11/2005 | Petersen et al. |
| 2006/0035112 | A1 | 2/2006 | Veeramasuneni et al. |
| 2006/0092759 | A1 | 5/2006 | Petersen et al. |
| 2006/0198995 | A1 | 9/2006 | Nideborn et al. |
| 2006/0243171 | A1 | 11/2006 | Yu et al. |
| 2006/0244182 | A1 | 11/2006 | Wittbold et al. |
| 2006/0244183 | A1 | 11/2006 | Wittbold et al. |
| 2006/0278133 | A1 | 12/2006 | Yu et al. |
| 2006/0283974 | A1 | 12/2006 | Eguchi et al. |
| 2007/0022913 | A1 | 2/2007 | Wang et al. |
| 2007/0048490 | A1 | 3/2007 | Yu et al. |
| 2007/0048549 | A1 | 3/2007 | Song et al. |
| 2007/0059513 | A1 | 3/2007 | Yu et al. |
| 2007/0251628 | A1 | 11/2007 | Yu et al. |
| 2008/0000392 | A1 | 1/2008 | Blackburn et al. |
| 2008/0009565 | A1 | 1/2008 | Wittbold et al. |
| 2008/0069762 | A1 | 3/2008 | Lynn et al. |
| 2008/0090068 | A1 | 4/2008 | Yu et al. |
| 2008/0110276 | A1 | 5/2008 | Frank et al. |
| 2008/0141909 | A1 | 6/2008 | Immordino et al. |
| 2008/0299413 | A1 | 12/2008 | Song et al. |
| 2009/0090796 | A1 | 4/2009 | Tian |
| 2009/0134550 | A1 | 5/2009 | Dehennau et al. |
| 2009/0239977 | A1 | 9/2009 | Dubey et al. |
| 2009/0257303 | A1 | 10/2009 | Rayner et al. |
| 2009/0297765 | A1 | 12/2009 | Domey et al. |
| 2010/0077939 | A1 | 4/2010 | Trout |
| 2010/0081008 | A1 | 4/2010 | Trout |
| 2010/0139528 | A1 | 6/2010 | Yu et al. |
| 2010/0227073 | A1 | 9/2010 | Frank et al. |
| 2010/0229714 | A1 | 9/2010 | Tonyan et al. |
| 2010/0239886 | A1 | 9/2010 | Yu et al. |
| 2010/0291305 | A1 | 11/2010 | Wittbold et al. |
| 2011/0054053 | A1 | 3/2011 | Lee et al. |
| 2011/0186664 | A1 | 8/2011 | Lucas et al. |
| 2011/0192518 | A1 | 8/2011 | Li |
| 2011/0195241 | A1 | 8/2011 | Yu et al. |
| 2011/0211418 | A1 | 9/2011 | Tassone et al. |
| 2011/0213043 | A1 | 9/2011 | Blackburn et al. |
| 2011/0213085 | A1 | 9/2011 | Tonelli et al. |
| 2011/0220586 | A1 | 9/2011 | Levitt |
| 2011/0271903 | A1 | 11/2011 | Durst et al. |
| 2011/0308432 | A1 | 12/2011 | Wittbold et al. |
| 2012/0131857 | A1 | 5/2012 | Ross-da Silva |
| 2012/0167805 | A1 | 7/2012 | Wittbold et al. |
| 2012/0168527 | A1 | 7/2012 | Li et al. |
| 2012/0170403 | A1 | 7/2012 | Li et al. |
| 2012/0251813 | A1 | 10/2012 | Yu et al. |
| 2012/0304545 | A1 | 12/2012 | Park et al. |
| 2012/0308463 | A1 | 12/2012 | Li et al. |
| 2013/0098268 | A1 | 4/2013 | Li et al. |
| 2013/0099027 | A1 | 4/2013 | Li et al. |
| 2013/0099418 | A1 | 4/2013 | Li et al. |
| 2013/0100759 | A1 | 4/2013 | Wittbold et al. |
| 2013/0216717 | A1 | 8/2013 | Rago et al. |
| 2013/0233880 | A1 | 9/2013 | Rago et al. |
| 2013/0308411 | A1 | 11/2013 | Wittbold et al. |
| 2014/0073711 | A1 | 3/2014 | Lee et al. |
| 2014/0090730 | A1 | 4/2014 | Buettner et al. |
| 2015/0231799 | A1 | 8/2015 | Wittbold et al. |
| 2017/0210029 | A1 | 7/2017 | Li et al. |

FOREIGN PATENT DOCUMENTS

| | | | |
|---|---|---|---|
| CN | 2928447 | Y | 8/2007 |
| CN | 201015893 | Y | 2/2008 |
| CN | 201685321 | U | 12/2010 |
| CN | 203266908 | U | 11/2013 |
| CN | 204076480 | U | 1/2015 |
| CN | 203957095 | U | 11/2016 |
| DE | 353695 | | 5/1922 |
| DE | 3808698 | A1 | 9/1989 |
| DE | 3932573 | A1 | 4/1991 |
| DE | 29514043 | | 11/1995 |
| DE | 19757678 | A1 | 6/1999 |
| DE | 102008041423 | A1 | 2/2010 |
| DE | 202009014417 | U1 | 2/2010 |
| DE | 202011100879 | U1 | 6/2011 |
| DE | 102010010872 | A1 | 9/2011 |
| EP | 0003705 | | 2/1979 |
| EP | 0225261 | A1 | 6/1987 |
| EP | 0997784 | A1 | 5/2000 |
| EP | 1085280 | A1 | 3/2001 |
| EP | 1396696 | A2 | 3/2004 |
| EP | 1491262 | A2 | 12/2004 |
| EP | 2363269 | A1 | 9/2011 |
| EP | 2514294 | | 10/2012 |
| FR | 1357221 | | 4/1964 |
| FR | 2112808 | A5 | 6/1972 |
| GB | 1317359 | A | 5/1973 |
| GB | 1420686 | | 1/1976 |
| GB | 1520258 | A | 8/1978 |
| GB | 2026372 | A | 2/1980 |
| GB | 2044163 | A | 10/1980 |
| GB | 2246694 | A | 2/1992 |
| GB | 2410909 | | 8/2005 |
| JP | 51-90356 | U | 7/1976 |
| JP | H06-190845 | A | 7/1994 |
| JP | H07-52130 | A | 2/1995 |
| JP | H07-88419 | A | 4/1995 |
| JP | H08-281626 | A | 10/1996 |
| JP | 9094814 | A | 4/1997 |
| JP | H09-141700 | A | 6/1997 |
| JP | 9273421 | A | 10/1997 |
| JP | H11-501002 | A | 1/1999 |
| JP | 11148589 | | 6/1999 |
| JP | H11-170235 | A | 6/1999 |
| JP | H11-188301 | A | 7/1999 |
| JP | 2000-505163 | A | 4/2000 |
| JP | 2001-062821 | A | 3/2001 |

(56) References Cited

FOREIGN PATENT DOCUMENTS

| | | | |
|---|---|---|---|
| JP | 2001-300933 | A | 10/2001 |
| JP | 2004130672 | | 4/2004 |
| JP | 2005-021894 | A | 1/2005 |
| JP | 2005-211871 | A | 8/2005 |
| JP | 2006-095469 | A | 4/2006 |
| JP | 2006-334483 | A | 12/2006 |
| JP | 2008-229560 | A | 10/2008 |
| JP | 2009-045513 | A | 3/2009 |
| RU | 2257294 | A | 5/2005 |
| RU | 2313451 | C2 | 12/2007 |
| SU | 1033204 | A1 | 8/1983 |
| TW | I350228 | B | 10/2011 |
| WO | WO 1993024290 | | 12/1993 |
| WO | WO 97/05305 | A1 | 2/1997 |
| WO | WO 98/25069 | A1 | 6/1998 |
| WO | WO 2004/101402 | A1 | 11/2004 |
| WO | 2006/137800 | A2 | 12/2006 |
| WO | WO 2010/142034 | A1 | 12/2010 |
| WO | WO 2011134844 | A1 | 11/2011 |
| WO | WO 2011150455 | A1 | 12/2011 |
| WO | WO 2012076526 | | 6/2012 |
| WO | WO 2012/092534 | A1 | 7/2012 |
| WO | WO 2012/092582 | A1 | 7/2012 |
| WO | WO 2013/063044 | A1 | 5/2013 |
| WO | WO 2013/063055 | A2 | 5/2013 |
| WO | WO 2013/063073 | A2 | 5/2013 |
| WO | WO 2013/063080 | A2 | 5/2013 |
| WO | WO 2013/063055 | A3 | 6/2013 |
| WO | 2014/066211 | A1 | 5/2014 |
| WO | 2014/066283 | A1 | 5/2014 |

OTHER PUBLICATIONS

Mueller et al., "Controlling Set Times during Gypsum Board Production: Advance Additive Solutions", Global Gypsum Conference, Oct. 2011.

Peterson, Kurt, "Engineered Gypsum Panels, the Development and Application of Densified Zones at the Paper/Core Interface of Gypsum Panels", Proceedings of Gypsum 2000, 6th International Conference on Natural and Synthetic Gypsum, Toronto, Canada, May 2000, pp. 9-1-9-16.

Teejet; "TeeJet LF 500 Slurry Controller," http://teejet.com/english/home/products/application-control-and-equipment/slurry-application-controls/teejet--lh-500-slurry-controller.aspx, accessed Jan. 8, 2015.

European Patent Office, International Search Report and Written Opinion in International Application No. PCT/US2011/068033 (dated May 3, 2012).

European Patent Office, International Search Report and Written Opinion in International Application No. PCT/US2011/068167 (dated May 11, 2012).

SLURRY DISTRIBUTION SYSTEM AND METHOD

CROSS-REFERENCE TO RELATED APPLICATION

This patent application is a continuation of U.S. patent application Ser. No. 13/341,016, filed Dec. 30, 2011, and entitled, "Slurry Distribution System and Method", which in turn, claims the benefit of priority to U.S. Provisional Patent Application Nos. 61/428,706, filed Dec. 30, 2010, and entitled, "Slurry Distributor, System and Method for Using Same"; 61/428,736, filed Dec. 30, 2010, and entitled, "Slurry Distribution System and Method"; and 61/550,827, filed Oct. 24, 2011, and entitled, "Slurry Distributor, System, Method for Using, and Method for Making Same," which are all incorporated in their entireties herein by this reference.

BACKGROUND

The present disclosure relates to continuous board manufacturing processes and, more particularly, to an apparatus, system and method for the distribution of an aqueous gypsum slurry.

In a typical continuous gypsum manufacturing process, for example, a process such as those used to manufacture wallboard, water, calcined gypsum (i.e., stucco) and other additives as desired are combined and mixed in a pin mixer. Aqueous foam can be injected either in the mixer or outside the mixer to control the dry board density. Stucco is in the form of calcium sulfate hemihydrate and/or calcium sulfate anhydrite. The slurry is deposited onto a continuously advancing paper web moving on a conveyor. The slurry is allowed to spread over the advancing web of cover sheet material before a second web of cover sheet material is applied to cover the slurry and form a sandwich structure of a continuous wallboard preform, which is subjected to forming, such as at a conventional forming station, to obtain a desired thickness. The calcined gypsum reacts with the water in the preform and sets as the conveyor moves the preform down a manufacturing line. The preform is cut into segments at a point along the line where the preform has set sufficiently, flipped over, dried (e.g., in a kiln) to drive off excess water, and processed to provide the final wallboard product of desired dimensions.

The weight proportion of water relative to stucco that is mixed is referred to in the art as the "water-stucco ratio" (WSR). In the continuous wallboard production process industry, it is strongly desired to reduce the WSR to enhance manufacturing efficiency, for example, by reducing the energy required to dry the final products. However, a reduction of the WSR is not easily attainable. For example, slurry compositions having a higher water content have a lower viscosity, which can help spread the slurry across the width of the cover sheet web as it advances toward the forming station.

Prior apparatus and methods for addressing some of the operational problems associated with the production of gypsum wallboard are disclosed in commonly-assigned U.S. Pat. Nos. 5,683,635; 5,643,510; 6,494,609; 6,874,930; 7,007,914; and 7,296,919, which are incorporated herein by reference.

SUMMARY

In one aspect, the disclosure describes a slurry distributor for use in a continuous manufacturing process includes an inlet opening and a shaped duct adapted to receive a flow of slurry provided at the inlet opening. The shaped duct has a parabolic guide surface adapted to redirect the flow of slurry. An outlet opening in fluid communication with the shaped duct is adapted to receive the flow of slurry.

In some embodiments, a slurry distributor for use in a continuous manufacturing process includes an entry segment defining an inlet opening, a shaped duct in fluid communication with the inlet opening, and an outlet defining an outlet opening in fluid communication with the shaped duct. The shaped duct includes a parabolic guide surface adapted to redirect a flow of slurry moving from the inlet opening through the shaped duct to the outlet opening from an inlet direction to an outlet direction.

In another aspect, the disclosure describes a method for providing a slurry to an advancing web. The method includes passing a flow of aqueous gypsum slurry through an inlet of a slurry distributor having a shaped duct with a parabolic guide surface adapted to redirect the flow of slurry toward an outlet opening thereof. The flow of aqueous gypsum slurry is discharged through the outlet.

In some embodiments, a method for providing a slurry to an advancing web is provided. A flow of aqueous gypsum slurry is passed in an inlet flow direction through an inlet of a slurry distributor having a shaped duct with a parabolic guide surface such that the parabolic guide surface redirects the flow of slurry from the inlet flow direction to an outlet flow direction toward an outlet opening of the slurry distributor. The flow of the aqueous gypsum slurry is discharged from the outlet in the outlet flow direction upon an advancing web of cover sheet material.

In yet another aspect, the disclosure describes a gypsum slurry mixing and dispensing assembly. The assembly includes a gypsum slurry mixer adapted to agitate water and calcined gypsum to form an aqueous gypsum slurry. A slurry distributor in fluid communication with the gypsum slurry mixer is adapted to receive a flow of aqueous gypsum slurry from the gypsum slurry mixer and distribute the flow of aqueous gypsum slurry onto an advancing web. The slurry distributor includes an inlet opening and a shaped duct adapted to receive the flow of aqueous gypsum slurry provided at the inlet opening. The shaped duct has a parabolic guide surface adapted to redirect the flow of aqueous gypsum slurry. An outlet opening in fluid communication with the shaped duct is adapted to receive the flow of aqueous gypsum slurry.

In some embodiments, a gypsum slurry mixing and dispensing assembly includes a mixer adapted to agitate water and calcined gypsum to form an aqueous calcined gypsum slurry and a slurry distributor in fluid communication with the mixer. The slurry distributor includes an entry segment defining an inlet opening and adapted to receive the flow of aqueous calcined gypsum slurry, a shaped duct in fluid communication with the inlet opening, and an outlet defining an outlet opening in fluid communication with the shaped duct and adapted to discharge the flow of aqueous calcined gypsum slurry from the slurry distributor. The shaped duct includes a parabolic guide surface adapted to redirect the flow of aqueous calcined gypsum slurry moving from the inlet opening through the shaped duct to the outlet opening from an inlet direction to an outlet direction by a change in direction angle within a range of about forty-five degrees to about one hundred fifty degrees.

DETAILED DESCRIPTION

Figure 1:
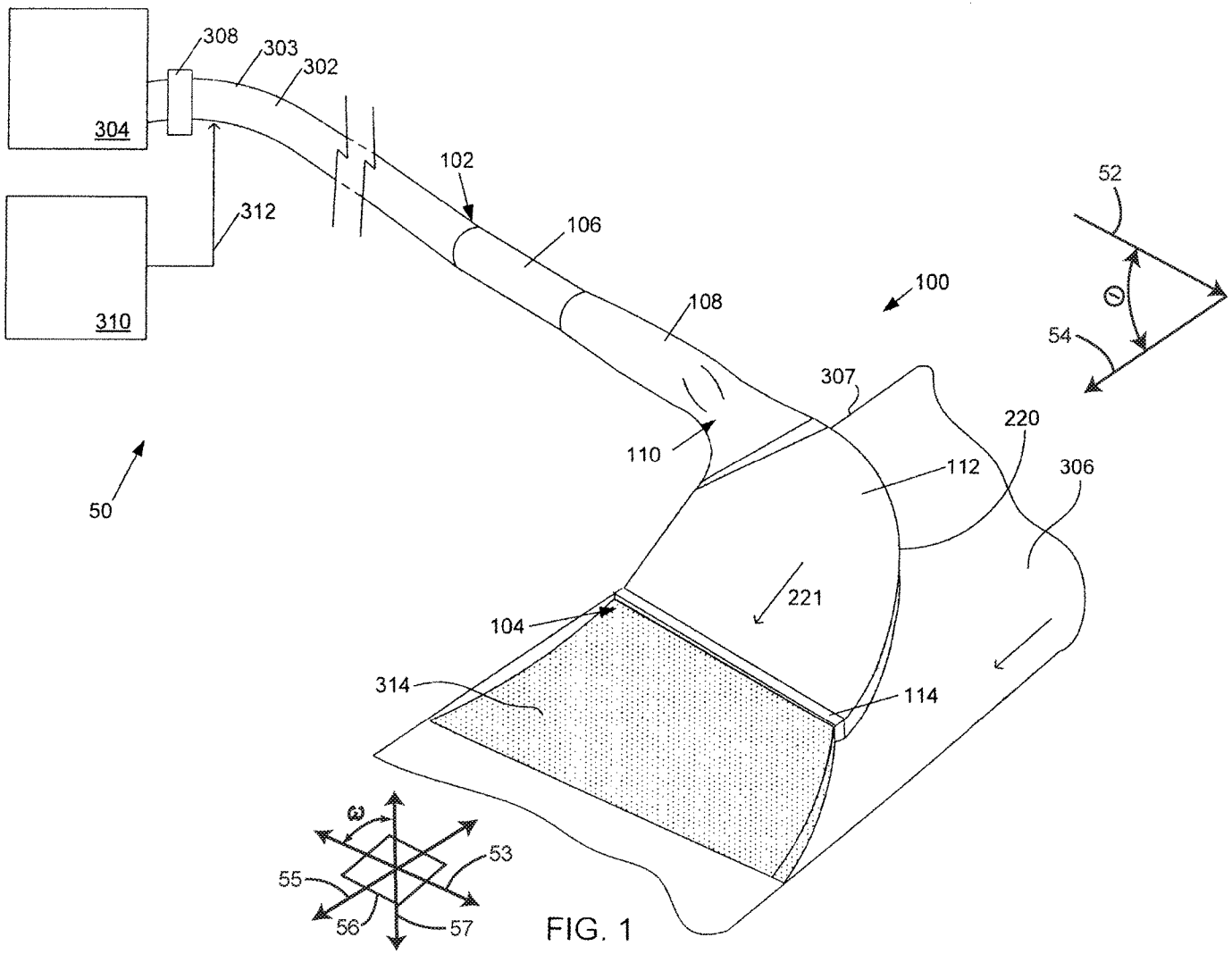
FIG. 1 is a perspective view of an embodiment of a gypsum slurry mixing and dispensing assembly including a slurry distributor in accordance with the disclosure.
Figure 2:
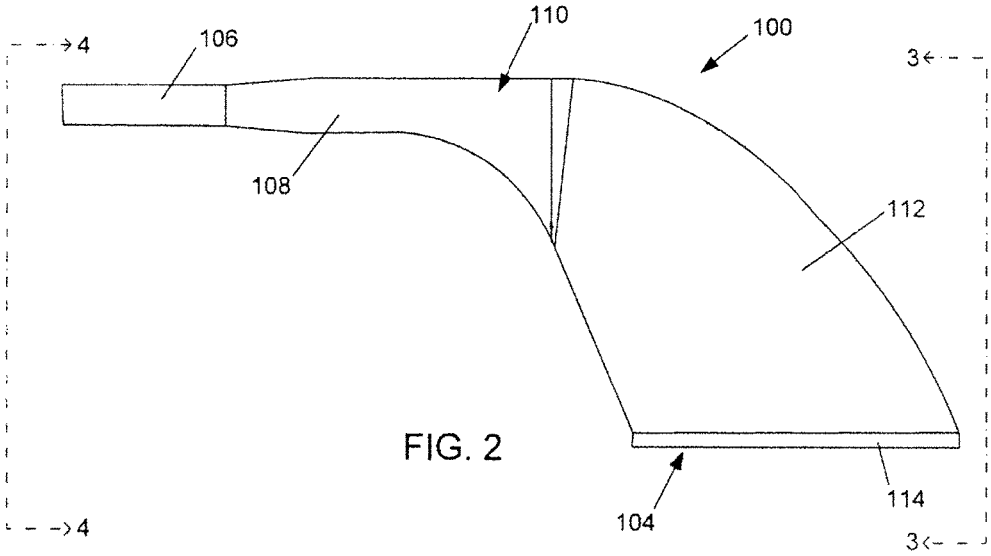
FIG. 2 is a top plan view of the slurry distributor of FIG. 1.

The disclosure relates to a distribution system for distributing an aqueous gypsum onto an advancing web (e.g., paper or mat) moving on a conveyor during a continuous manufacturing process, such as a wallboard manufacturing process. A slurry distribution system of the present disclosure is aimed at accomplishing wider spreading for slurries at present WSR or slurries having relatively low WSR and, therefore, relatively higher viscosity. In general, the disclosed system and method is suitable for slurries having relatively high viscosity due to low WSR or to special formulations. The spreading is controlled by routing and distributing the slurry using a distribution system as shown and described hereinafter. In the description that follows, features and structures shown and described relative to one embodiment and that are the same or similar to corresponding features and structures of alternate embodiments are denoted by the same reference numerals for simplicity.

Embodiments of a slurry distributor constructed in accordance with principles of the present disclosure can advantageously be configured as a retrofit in an existing wallboard manufacturing system to help allow the system to make wallboard using slurries having a typical WSR to a lower WSR. The slurry distributor can be used with components from a conventional discharge conduit, such as in the form of a gate-canister-boot arrangement as known in the art, or an arrangement as described in U.S. Pat. Nos. 6,494,609; 6,874,930; 7,007,914; and/or 7,296,919. For example, the slurry distributor 100 can replace a conventional single or multiple-branch boot or may, alternatively, be attached to one or more mixer outlet conduits.

FIG. 1 is a perspective view of one embodiment of a gypsum slurry mixing and dispensing assembly 50 including a gypsum slurry mixer 304 and a slurry distributor 100. The slurry distributor 100 is of the type that can comprise a part of, or act as, a discharge conduit 302 of a conventional gypsum slurry mixer 304 (e.g., a pin mixer) as is known in the art that provides a continuous flow of aqueous calcined gypsum slurry from the mixer 304.

The gypsum slurry mixer 304 is adapted to agitate water and calcined gypsum to form the aqueous calcined gypsum slurry. It is contemplated that any suitable mixer can be used with the slurry distributor 100. In various embodiments, the mixer 304 can be located above, alongside, or at a distance from the forming table/conveyor comprising the manufacturing line.

The slurry distributor 100 is in fluid communication with the gypsum slurry mixer 304 and is adapted to receive a flow of aqueous gypsum slurry from the gypsum slurry mixer 304 and distribute the flow of aqueous gypsum slurry onto an advancing web 306. In the illustrated embodiment, a delivery conduit 303 is disposed between and in fluid communication with the gypsum slurry mixer 304 and the slurry distributor 100.

The slurry distributor 100 can be connected downstream of one or more flow-modifying elements 308 associated with the delivery conduit 303 to control a flow of the aqueous gypsum slurry. Examples of suitable flow-modifying elements include volume restrictors, pressure reducers, constrictor valves, canisters, etc., including those described in U.S. Pat. Nos. 6,494,609; 6,874,930; 7,007,914; and 7,296,919, for example.

An aqueous foam supply conduit 312 can be in fluid communication with at least one of the gypsum slurry mixer 304 and the delivery conduit 303. An aqueous foam from a source 310 can be added to the constituent materials through the foam conduit 312 at any suitable location downstream of the mixer 304 and/or in the mixer 304 itself to form a foamed gypsum slurry 314 that is provided to the slurry distributor 100.

When the foamed gypsum slurry sets and is dried, the foam dispersed in the slurry produces air voids therein which act to lower the overall density of the wallboard. The amount of foam and/or amount of air in the foam can be varied to adjust the dry board density such that the resulting wallboard product is within a desired weight range.

Any suitable foaming agent can be used. Preferably, the aqueous foam is produced in a continuous manner in which a stream of the mix of foaming agent and water is directed to a foam generator, and a stream of the resultant aqueous foam leaves the generator and is directed to and mixed with the calcined gypsum slurry. Some examples of suitable foaming agents are described in U.S. Pat. Nos. 5,683,635 and 5,643,510, for example.

As one of ordinary skill in the art will appreciate, one or both of the webs of cover sheet material can be pre-treated with a very thin relatively denser layer of gypsum slurry (relative to the gypsum slurry comprising the core), often referred to as a skim coat in the art, over the field of the web and/or at least one denser stream of gypsum slurry at the edges of the web to produce hard edges, if desired. To that end, the mixer 304 can include a first auxiliary conduit that is adapted to deposit a stream of dense aqueous calcined gypsum slurry that is relatively denser (i.e., a "face skim coat/hard edge stream") than the stream of aqueous calcined gypsum slurry delivered to the slurry distributor 100. The first auxiliary conduit can deposit the face skim coat/hard edge stream upon the advancing web 306 of cover sheet material upstream of a skim coat roller (itself upstream of the slurry distributor 100) that is adapted to apply a skim coat layer to the advancing web 306 of cover sheet material and to define hard edges at the periphery of the moving web 306 by virtue of the width of the roller being less than the width of the moving web as is known in the art. Hard edges can be formed from the same dense slurry that forms the thin dense layer by directing portions of the dense slurry around the ends of the roller used to apply the dense layer to the web 306.

The mixer 304 can also include a second auxiliary conduit adapted to deposit a stream of dense aqueous calcined gypsum slurry that is relatively denser (i.e., a "back skim coat stream") than the stream of aqueous calcined gypsum slurry delivered to the slurry distributor 100. The second auxiliary conduit can deposit the back skim coat stream upon a second moving web of cover sheet material upstream (in the direction of movement of the second web) of a skim coat roller that is adapted to apply a skim coat layer to the second moving web of cover sheet material as is known in the art. The second web can be applied to cover the slurry and to form a sandwich structure of a continuous wallboard preform.

In other embodiments, separate auxiliary conduits can be connected to the mixer 304 to deliver one or more separate edge streams to the advancing web 306 of cover sheet material. Other suitable equipment (such as auxiliary mixers) can be provided in the auxiliary conduits to help make the slurry therein denser, such as by mechanically breaking up foam in the slurry and/or by chemically breaking down the foam through use of a suitable de-foaming agent.

In the illustrated embodiment of FIG. 1, the slurry distributor 100 includes a slurry inlet opening 102, a slurry outlet opening 104, and a shaped duct 112 adapted to receive the flow of slurry provided at the inlet opening 102. The shaped duct 112 has a parabolic guide surface 220 adapted to redirect the flow of slurry from an inlet flow direction 52, which is substantially parallel to a cross-machine direction 53, to an outlet flow direction 54, which is substantially parallel to a machine direction 55 and substantially perpendicular to the inlet flow direction 52. The outlet opening 104 is in fluid communication with the shaped duct 112 and adapted to receive the flow of slurry from the duct 112 and discharge the slurry from the slurry distributor 100 along the outlet flow direction 54 upon the web 306 advancing along the machine direction.

Figure 3:
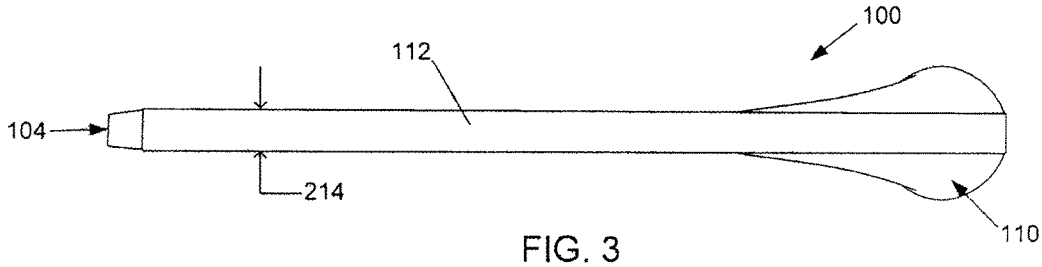
FIGS. 3 and 4 are, respectively, right and left elevational views of the slurry distributor of FIG. 1.
Figure 4:
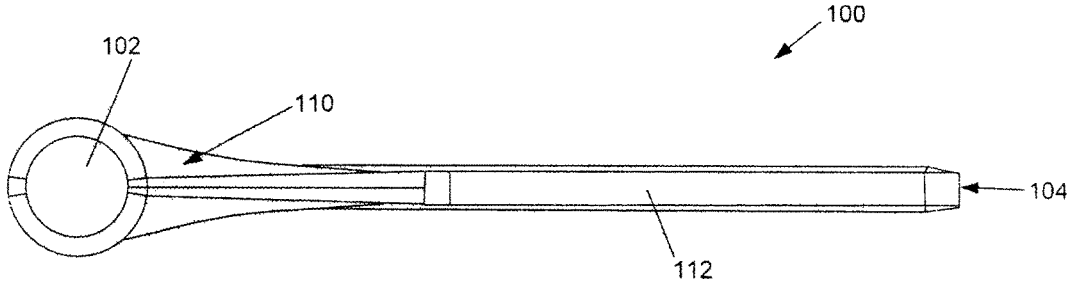

The slurry inlet 102 is formed at an end of a hollow and generally straight and cylindrical entry segment 106. The generally straight entry segment 106 is connected to a connector segment 108 that includes a round-to-rectangular cross section transition segment 110, as is best shown in FIGS. 3 and 4. In the illustrated embodiment, the angled and shaped duct 112 has a generally rectangular section and is connected to the transition segment 110. In alternate embodiments, the shaped duct 112 may have a generally trapezoidal cross section in which the height of the inner and outer walls of the duct are different. In still other embodiments, the shapes of the components of the slurry distributor 100 can be different.

The duct 112 further includes an adjustable outlet frame 114 that defines the outlet opening 104. As shown, the outlet frame 114 is generally rectangular but other shapes may be used that are consistent with the shape of the duct 112.

The shaped duct 112 is thus fluidly connected to the entry segment 106 and forms the outlet opening 104 to thereby provide fluid communication between the inlet opening 102 and the outlet opening 104 such that a flow of slurry entering the inlet opening 102 travels through the cylindrical entry segment 106, the connector segment 108, the transition segment 110, and the shaped duct 112 and is discharged from the slurry distributor 100 through the outlet opening 104.

The duct 112 has a generally rectangular cross section and a generally curved outer wall that defines a parabolic guide surface 220. The curved or parabolic guide surface 220 is configured such that a flow of slurry entering the slurry distributor 100 through the inlet opening 102 is redirected by a change in direction angle θ before exiting through the outlet opening 104. For example, in the illustrated embodiment, the flow of slurry is redirected from the inlet flow direction 52 along the cross-machine direction 53 through a direction angle θ of about ninety degrees about the vertical axis 57 to the outlet flow direction 54 along the machine direction 55. In some embodiments, the flow of slurry can be redirected from an inlet flow direction 52 through a change in direction angle θ about the vertical axis 57 within a range of about forty-five degrees to about one hundred fifty degrees to the outlet flow direction 54.

In some embodiments, the outlet flow direction is substantially parallel to a plane 56 defined by the machine direction 55 and the transverse cross-machine direction 53 of the system transporting the advancing web 306 of cover sheet material. In other embodiments, the inlet flow direction 52 and the outlet flow direction are both substantially parallel to the plane 56 defined by the machine direction 55 and the transverse cross-machine direction 53 of the system transporting the advancing web 306 of cover sheet material. In some embodiments, the slurry outlet opening 104 can be substantially parallel to the plane 56 defined by the machine direction 55 and the transverse cross-machine direction 53. In some embodiments, the slurry distributor can be adapted and arranged with respect to the forming table such that the flow of slurry is redirected in the slurry distributor from the inlet flow direction 52 to the outlet flow direction 54 without undergoing substantial flow redirection by rotating about the cross-machine direction 53. In some embodiments, the slurry distributor can be adapted and arranged with respect to the forming table such that the flow of slurry is redirected in the slurry distributor from the inlet flow direction 52, which includes a velocity profile having at least about twenty-five percent of its movement in the cross-machine direction 53, to the outlet flow direction 54, which includes a velocity profile having at least about eighty percent of its movement in the machine direction 55.

In some embodiments, the slurry distributor can be adapted and arranged with respect to the forming table such that the flow of slurry is redirected in the slurry distributor from the inlet flow direction 52 to the outlet flow direction 54 by redirecting the slurry by rotating about the cross-machine direction 53 over an angle of about forty-five degrees or less. Such a rotation can be accomplished in some embodiments by adapting the slurry distributor such that the slurry inlet opening 102 and the inlet flow direction 52 are disposed at a vertical offset angle ω with respect to the plane 56 formed by the machine axis 55 and the cross-machine axis 53 and a vertical axis 57, which is mutually perpendicular to the machine axis 55 and the cross-machine axis 53. In embodiments, the slurry inlet opening 102 and the inlet flow direction 52 can be disposed at a vertical offset angle ω within a range from zero to about sixty degrees such that the flow of slurry is redirected about the machine axis 55 and moves along the vertical axis 57 in the slurry distributor from the inlet flow direction 52 to the outlet flow direction 54. In embodiments, at least one of the entry segment 106, the connector segment 108, the transition segment 110, and the shaped duct 112 can be adapted to facilitate the redirection of the slurry about the machine axis 55 and along the vertical axis 57. In embodiments the flow of slurry can be redirected from an inlet flow direction 52 through a change in direction angle θ about an axis substantially perpendicular to vertical offset angle ω and/or one or more other rotational axes within a range of about forty-five degrees to about one hundred fifty degrees to the outlet flow direction 54 such that the outlet flow direction 54 is generally aligned with the machine direction 55.

The duct 112 has a cross sectional flow area that increases in a direction 221 from the inlet opening 102 toward the outlet opening 104 such that the flow of slurry is decelerated as it passes through the duct 112. In the illustrated embodiment, for example, the cross sectional area of the slurry distributor 100 increases at the outlet 104 by about 340% relative to the inlet 102, but any suitable variation is contemplated. For example, in some embodiments, the increase in cross-sectional area can vary over a range from greater than 0% to about 400% increase. In other embodiments, the ratio of the cross-sectional area of the inlet 102 to the outlet 104 can be varied based upon one or more factors, including the speed of the manufacturing line, the viscosity of the slurry being distributed by the distributor 100, the width of the board product being made with the distributor 100, etc.

During operation, a flow of slurry is provided at the slurry inlet 102 from the mixer 304. The flow of slurry passes through the internal portions of the various distributor segments 106, 108, 112 before exiting through the slurry outlet 104. The cross sectional area of the slurry distributor 100 gradually increases along the slurry path from the inlet 102 to the outlet 104 such that the flow of slurry passing therethrough decelerates before exiting the outlet 104. The slurry 314 is deposited from the slurry distributor 100 onto an advancing web 306 of cover sheet material and a second web of cover sheet material is applied over the deposited slurry to form wall board preforms. As one of ordinary skill in the art will appreciate, board products are typically formed "face down" such that the advancing web 306 serves as the "face" liner of the board after it is installed.

By use of the distributor 100, the deceleration and directional manipulation of the slurry through the appropriate shaping of the transition segment 110 and the shaped duct 112 enables use of more viscous slurries having lower WSRs with reduced air-slurry separation and with acceptable and controllable material distribution at the outlet 104. As used herein, air-slurry separation is meant to describe conditions in which air pockets form in the slurry, which can cause high and low pressure areas within the slurry and that may result in detrimental density variations in the finished product.

Figure 5:
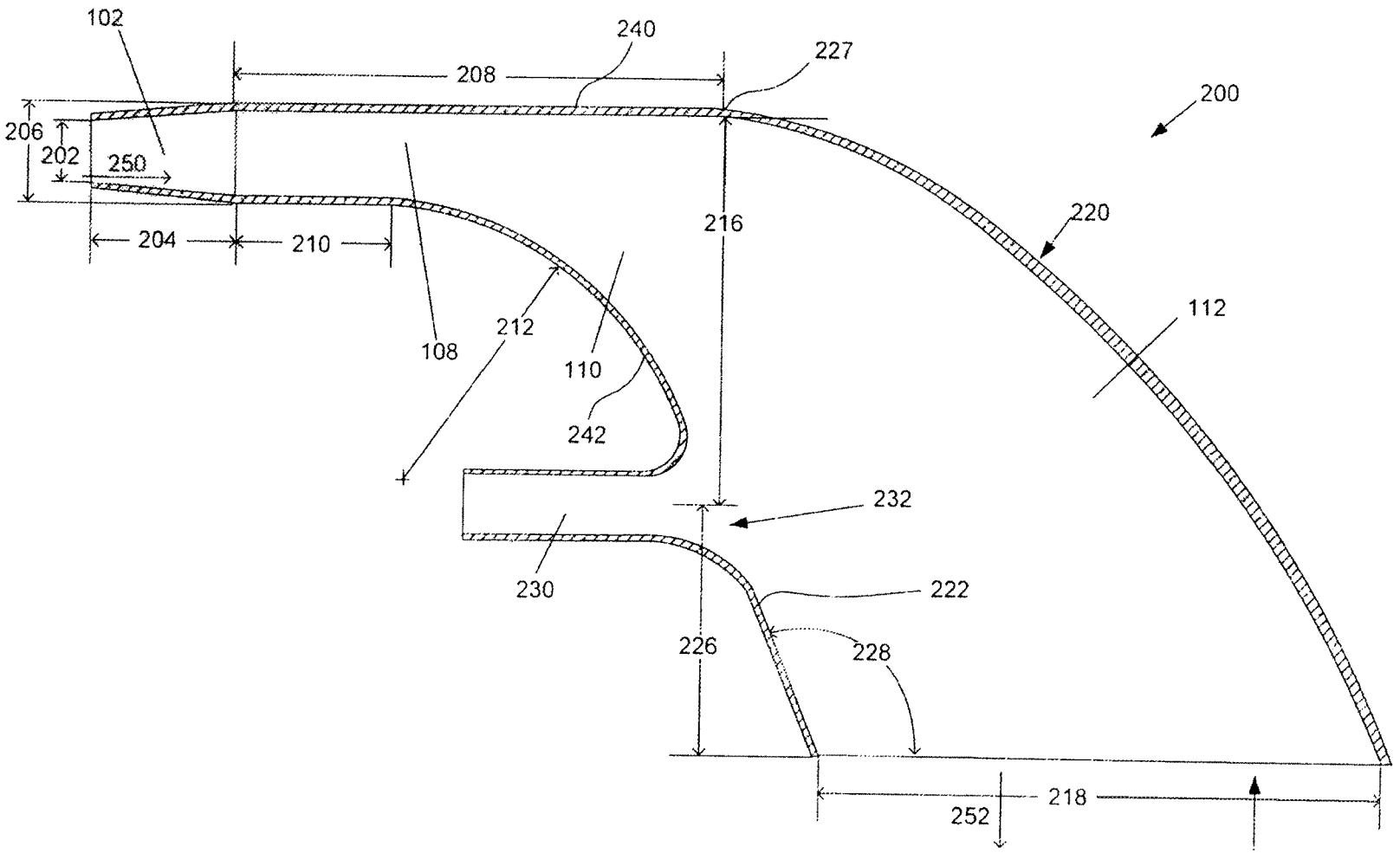
FIG. 5 is a top plan view, in section, of another embodiment of a slurry distributor in accordance with the disclosure.

Referring to FIG. 5, a cross section of one embodiment of a slurry distributor 200, which has been configured for the production of wall board having a thickness of 0.75 in. (1.9 cm.), is shown. In the illustrated embodiment, the inlet opening 102 is circular having a diameter 202 of three inches. The inlet 102 has a frusto-conical shape having a length 204 of about six inches. The diameter of the inlet 102 increases from the inlet diameter 202 to an enlarged diameter 206, which in the illustrated embodiment is about four inches. The connector segment 108 has an overall length 208 of about 18 inches, which includes a straight cylindrical section 210 of about six inches. In this embodiment, the combined straight segment having lengths 204 and 210 is about four times the diameter 202 of the inlet 102 such that any directional imbalances caused by equipment upstream of the opening 102 in the slurry can be attenuated.

In the transition segment 110, the cross section of the slurry distributor 200 gradually changes from circular to generally rectangular in the direction of flow from the inlet 102 to the outlet 104. The transition segment 110 is at least partially defined by an outer straight wall 240 along at least a part of the length 208 and by an inner curved wall 242 having an inside radius of curvature 212, which in the illustrated embodiment is about thirteen inches. At this point, the cross sectional area of the slurry distributor 200 has increased by about 70% relative to the inlet opening 102. The inlet portion of the transition segment 112 has a generally-rectangular cross-sectional shape with a height 214 (see FIG. 3) of about one inch and a width 216 of about twelve inches (measured generally in the direction of travel of the web 306 in FIG. 1). As shown in FIG. 5, the width 218 of the opening 104 is sufficiently wide to expose the parabolic guide surface 220.

The transition segment 110 is connected to the shaped duct 112, which redirects the flow direction of the slurry stream by about 90 degrees. The duct 112 has a generally rectangular cross section, as is best shown in FIGS. 3 and 4, the width of which changes to an outlet width 218 of about twenty-four inches as the slurry approaches the outlet 104. As can be appreciated, the cross sectional area of the slurry distributor 200 doubles along the duct 112.

The duct 112 is at least partially defined by an outer curved wall or parabolic guide surface 220 and by an inner slanted wall 222 with curvature. The curved or parabolic guide surface 220 is configured to redirect the flow of slurry from an inlet direction 250 to an outlet direction 252. For example, the flow of slurry can be redirected such that the inlet direction 250 and the outlet direction 252 are generally perpendicular to each other and define an angle of about ninety degrees.

The outer curved wall or parabolic guide surface 220 has a generally parabolic shape in the plane of the cross section shown in FIG. 5, which in the illustrated embodiment is defined by a parabola of the form $Ax^2+B$. In alternate embodiments, higher order curves may be used in the shape of the guide surface 220 of the outer wall 220 or, alternatively, the wall 220 may have a generally curved shape that is made up of straight or linear segments that have been oriented at their ends to collectively define a generally curved wall. Moreover, the parameters used to define the specific shape factors of the guide surface of the outer wall can depend on specific operating parameters of the process in which the slurry distributor will be used. For example, parameters that may be considered when determining the particular shape of the outer wall include the viscosity of the slurry that will be used, the velocity of the manufacturing line, the mass or volumetric flow rate of slurry deposition, slurry density and the like. In the illustrated embodiment, $A=0.03$ and $B=-19.95$, with the origin coinciding with point 227 that is located at the outer intersection of the transition segment 110 with the duct 112. The width 218 of the outlet opening 104 is configured such that it is aligned with and exposes a substantial portion of the parabolic guide surface 220.

As shown in FIG. 5, slurry can be redirected by the parabolic guide surface 220 such that slurry exits the slurry distributor 200 via the outlet opening 104 having a predetermined velocity profile. For example, the slurry can have a substantially uniform velocity across the width 218 of the outlet opening 104. The shape of the curved guide surface 220 and/or the outlet opening 104 can be varied to adjust the velocity profile to achieve a desired spread pattern for the slurry.

The inner slanted wall 222 extends at an obtuse angle 228 relative to an outlet plane defined by the outlet opening 104. In the illustrated embodiment, the inner slanted wall 222 has a length 226 as shown in FIG. 5 of about 14.4 inches and is disposed at an obtuse angle 228 of about 112.6 degrees relative to the plane defined by the perimeter of the outlet 104.

The slurry distributor 200 of FIG. 5 includes a secondary slurry inlet 230 that is fluidly connected to the interior of the duct 112 through an opening 232 formed in the inner slanted wall 222. The second inlet opening 232 is in fluid communication with the shaped duct 112. During operation, an additional flow of slurry may be provided through the secondary slurry inlet 230 to augment the flow of slurry provided through the slurry inlet 202, especially for embodiments configured for larger width product, higher WSR, or higher line speeds in manufacturing.

In embodiments of a slurry distributor including a second inlet opening 232 in fluid communication with a shaped duct 112 (see FIG. 5), the second inlet 232 of the slurry distributor 200 can be placed in fluid communication with a gypsum slurry mixer 304 and be adapted to receive a second flow of aqueous gypsum slurry therefrom. In such embodiments, the delivery conduit 303 connecting the mixer 304 and the main inlet 102 of the slurry distributor 200 can include one or more branches to supply a secondary flow of aqueous gypsum slurry to the second inlet opening 232. In yet other embodiments, an auxiliary delivery conduit can be provided between the mixer 304 and the second inlet opening 232 of the slurry distributor 200.

Although the deceleration and flow shaping of the slurry passing through the slurry distributor is effective in helping to inhibit air separation in the slurry, additional features of the slurry distributor 100, 200 may be used to improve the distribution of the slurry after it exits the outlet of the spreader in a continuous manufacturing process. In the illustrated embodiments, the slurry distributor 100, 200 can be made of a plastically formable or deformable material that can be shaped into desired shapes. These shapes can be maintained and the plastic formability characteristics of the material may be configured to insure that the desired shape of certain sections of the spreader can be retained during operation of the spreader. Accordingly, different devices or shaping molds may be used to shape sections of the spreader or, alternatively, the spreader may be shaped manually using an iterative process.

In the illustrated embodiments, the distributor 100, 200 is made of a sheet metal, such as steel, which permits the forming of the portion of the spreader, for example, the frame 114 that surrounds the opening 104. The forming of the frame 114 may be accomplished manually by an operator or may alternatively be defined and secured by the attachment of an appropriately contoured plate (not shown) that is attached around at least a portion of the frame 114. In such an embodiment, the material of the frame 114 can be formed by being pushed into or otherwise urged into the various desired contour features of the contoured plate.

When determining a non-rectangular shape for the outlet opening 104, various aspects can be considered that can influence the final shape of the outlet to improve slurry distribution. For example, the positioning of the slurry outlet 104 relative to the centerline of an advancing web of backing material 306 in a continuous wall board manufacturing process (as shown in FIG. 1) may require a larger width of the opening to be formed adjacent the side of the opening that is further away from a side edge 307 of the web 306. Alternatively, or additionally, the shape of the slurry outlet may be symmetrical but configured to deliver a larger portion of the slurry in either the ends or the middle of the advancing web depending on the speed and inclination of the web.

Figure 6:
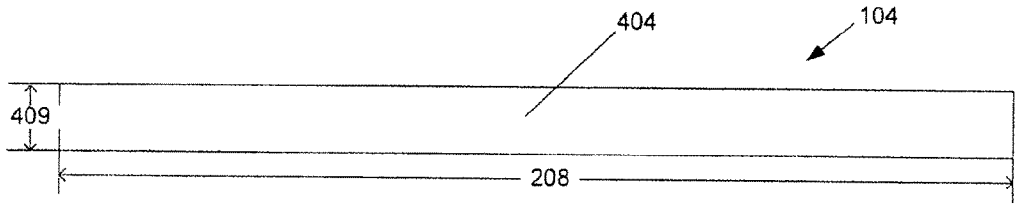
FIGS. 6-8 are fragmentary, front elevational views of an outlet opening suitable for use with a slurry distributor in accordance with the disclosure, illustrating various outlet opening shapes.
Figure 7:
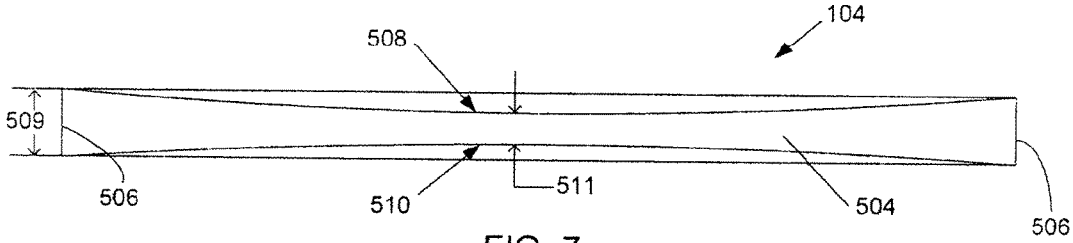
Figure 8:
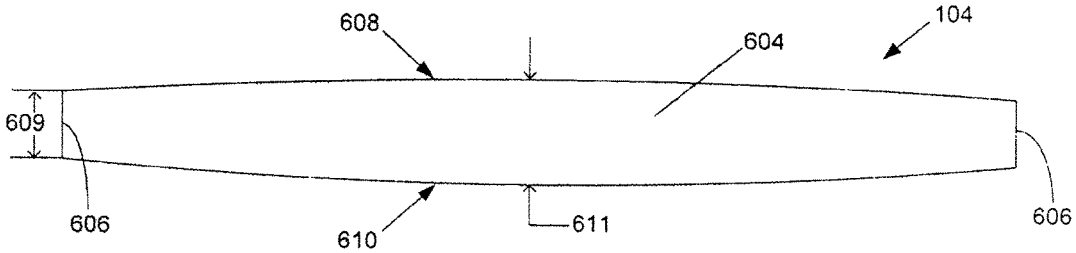

FIGS. 6-8 illustrate a few of an almost infinite number of configurations that may be used when forming the shape of the outlet 104. A baseline rectangular shaped opening 404 is shown in FIG. 6. The opening 404 has a length in the transverse direction or width 208, for example, of twenty four inches, and a height 409 of about one inch. The opening 404 is configured to provide a flow of slurry therethrough having a substantially uniform thickness.

A shaped opening 504 is shown in FIG. 7. As shown in the figure, the height 511 of the shaped opening 504 closer to its center is less than the height 509 of the opening 504 at its edges 506. In this embodiment, the top and bottom walls 508 and 510 have been curved toward one another such that a larger portion of the slurry passing through the opening 504 is distributed along the edges 506 than the middle of the opening.

An additional shaped opening 604 is shown in FIG. 8. The opening 604 has a barrel-shaped cross section in which the height 609 of the opening adjacent its edges 606 is less than the height 611 at the middle of the opening 604. As can be appreciated, this particular shape of the opening 604 can be achieved by outwardly curving the top and bottom walls 608, 610 away from one another. Although the shaped openings 404, 504, 604 are symmetrical, non-symmetrical configurations for particular applications may also be used as previously described.

Figure 9:
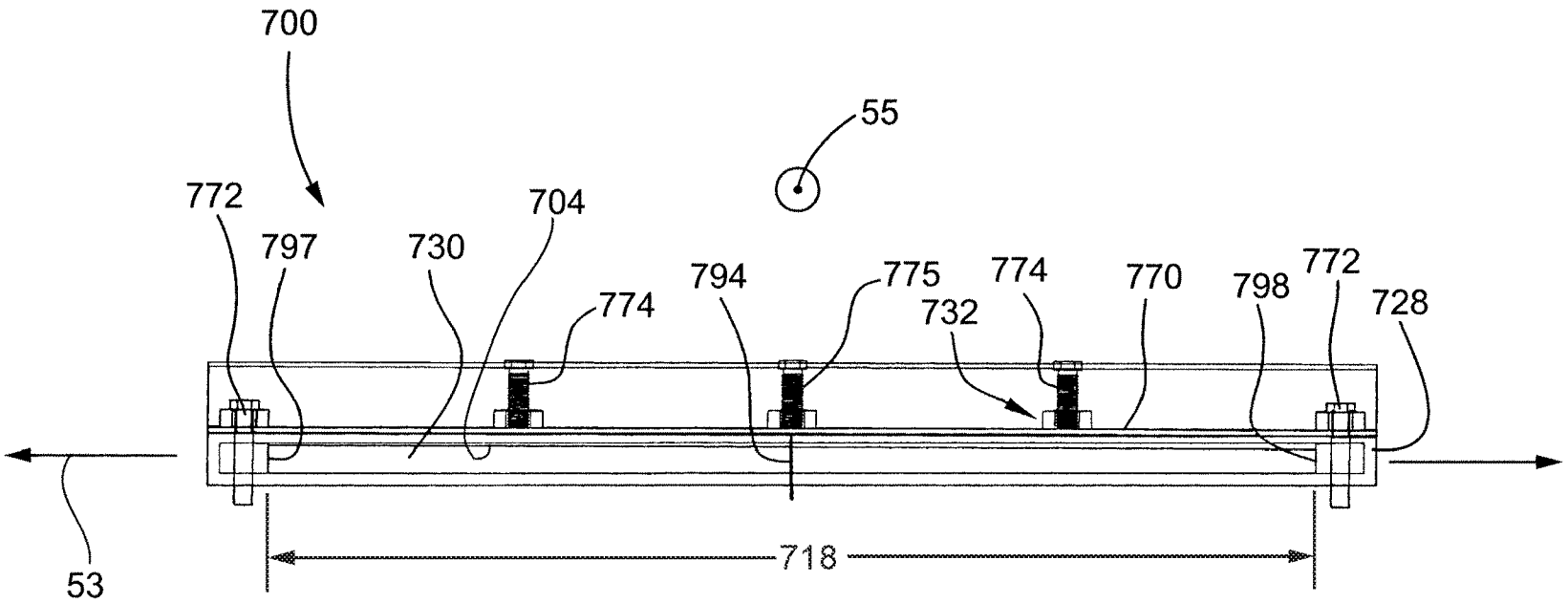
FIG. 9 is a fragmentary, front elevational view of a slurry distributor in accordance with the disclosure, illustrating an embodiment of a profiling system mounted to an outlet opening.

Referring to FIG. 9, a slurry distributor 700 according to principles of the present disclosure can include a profiling system 732 adapted to locally vary the size and shape of the opening 704 of the illustrated rectangular outlet 730. The profiling system 732 includes a plate 770, a plurality of mounting bolts 772 securing the plate to the shaped duct 728 adjacent the outlet 730, and a series of adjustment bolts 774 threadingly secured thereto. The mounting bolts 772 are used to secure the plate 770 to the shaped duct 728 adjacent the outlet 730. The plate 770 extends substantially along the width 718 of the outlet 730. In the illustrated embodiment, the plate 770 is in the form of a length of angle iron. In other embodiments, the plate 770 can have different shapes and can comprise different materials.

The adjustment bolts 774 are in regular, spaced relationship to each other along the width of the outlet 730. The adjustment bolts 774 are threadedly engaged with the plate 770. The adjustment bolts 774 are independently adjustable to allow the bolts to act upon the exterior surface of the outlet 730 to locally vary the size and/or shape of the opening 704 of the outlet 730. The outlet 730 is made from a resiliently flexible material such that its shape is adapted to be variable along its width in the transverse cross-machine direction, such as by the adjustment bolts 774, 775, for example.

The profiling system 732 can be used to locally vary the outlet 730 so as to alter the flow pattern of the aqueous calcined gypsum slurry being distributed from the slurry distributor 700. For example, the mid-line adjustment bolt 775 can be tightened down to constrict a transverse central midpoint 794 of the outlet 730 along the cross-machine direction 53 to increase the edge flow angle away from the perpendicular machine direction 55 to facilitate spreading as well as to improve the slurry flow uniformity in the cross-machine axis 53.

The profiling system 732 can be used to vary the size of the outlet 730 along the transverse cross-machine axis 53 and maintain the outlet 730 in the new shape. The plate 770 can be made from a material that is suitably strong such that the plate 770 can withstand opposing forces exerted by the adjustment bolts 774, 775 in response to adjustments made by the adjustment bolts 774, 775 in urging the outlet 730 into a new shape. The profiling system 732 can be used to help even out variations in the flow profile of the slurry being discharged from the outlet 730 such that the exit pattern of the slurry from the slurry distributor 700 is more uniform.

In other embodiments, the number of adjustment bolts can be varied such that the spacing between adjacent adjustment bolts changes. In other embodiments where the width of the distribution outlet 730 is different, the number of adjustment bolts can also be varied to achieve a desired adjacent bolt spacing. In yet other embodiments, the spacing between adjacent bolts can vary along the transverse axis 53, for example to provide greater locally-varying control at the side edges 797, 798 of the distribution outlet 730.

In general, the overall dimensions of the various embodiments for slurry distributors as disclosed herein can be scaled up or down depending on the type of product being manufactured, for example, the thickness and/or width of manufactured product, the speed of the manufacturing line being used, the rate of deposition of the slurry through the distributor, and the like. For example, in the illustrated embodiments, the width 218 of the rectangular slurry outlet (FIG. 5) for use in a wallboard manufacturing process, which conventionally is provided in nominal widths no greater than 54 inches, can range anywhere between eight to fifty-four inches, and in other embodiments between about eighteen inches and about thirty inches. The height of the outlet opening at its edges and the height of the duct 112, which is generally denoted as 214 in FIG. 3, can range anywhere from 3/16 inch to two inches, and in other embodiments between about 3/16 inch and about an inch. The ratio of the rectangular width to the rectangular height of the outlet opening can be from about 4 to about 288, and in other embodiments from about 18 to about 160. The diameter 202 of the slurry inlet can be anywhere between two to four inches, while the combined length of 204 and 210 (FIG. 5) can be between twelve and twenty four inches or more. The combined transverse length 216 and 226 (FIG. 5) can be anywhere between twelve and forty eight inches. All these ranges are approximate and can be individually selected and varied for each particular application.

A slurry distributor constructed in accordance with principles of the present disclosure can comprise any suitable material. In some embodiments, a slurry distributor can comprise any suitable substantially rigid material which can include a suitable material which can allow the size and shape of the outlet to be modified using a profile system, for example. For example, a suitably rigid plastic, such as ultra-high molecular weight (UHMW) plastic or metal can be used. In other embodiments, a slurry distributor constructed in accordance with principles of the present disclosure can be made from a flexible material, such as a suitable flexible plastic material, including poly vinyl chloride (PVC) or urethane, for example.

Any suitable technique for making a slurry distributor constructed in accordance with principles of the present disclosure can be used. For example, in embodiments where the slurry distributor is made from a flexible material, such as PVC or urethane, a multi-piece mold can be used. The exterior surface of the multi-piece mold can define the internal flow geometry of the slurry distributor. The multi-piece mold can be made from any suitable material, such as aluminum, for example. The mold can be dipped in a heated solution of flexible material, such as PVC or urethane. The mold can then be removed from the dipped material.

By making the mold out of multiple separate aluminum pieces that have been designed to fit together to provide the desired geometries, the mold pieces can be disengaged from each other and pulled out from the solution while it is still warm. At sufficiently-high temperatures, the flexible material is pliable enough to pull larger mold pieces through smaller areas of the molded slurry distributor without tearing it. In some embodiments, the mold piece areas are about 115%, and in other embodiments about 110%, or less than the area of the molded slurry distributor through which the mold piece is being pulled during removal. Connecting bolts can be placed to interlock and align the mold pieces so flashing at the joints is reduced and so the bolts can be removed to disassemble the multi-piece mold during removal of the mold from the interior of the molded slurry distributor.

A slurry distributor constructed in accordance with principles of the present disclosure can be used in a variety of manufacturing processes. For example, in one embodiment, a method for providing a slurry to an advancing web can be performed using a slurry distributor according to principles of the present disclosure. A flow of aqueous gypsum slurry is passed through an inlet of the slurry distributor which includes a shaped duct having a curved guide surface adapted to redirect the flow of slurry toward an outlet opening thereof. For example, the flow of slurry can be redirected by about 90 degrees so that the flow of slurry is redirected from a direction generally transverse to a line of travel of the web to a direction substantially parallel to the line of travel of the web. In other embodiments, the flow of slurry can be redirected from an inlet flow direction 52 through a change in direction angle θ within a range of about forty-five degrees to about one hundred fifty degrees to the outlet flow direction 54. The flow of slurry can decelerate while it passes through the shaped duct by configuring the shaped duct to have an increasing cross sectional flow area along at least a portion of a flow path from the inlet to the outlet. In some embodiments, at least one additional flow of slurry can be passed through the shaped duct through a secondary inlet of the shaped duct.

The flow of the aqueous gypsum slurry is discharged through the outlet such that it is deposited upon the web. The outlet flow direction 54 can be generally along the line of travel of the advancing web. The shape of the outlet opening can be adjusted to vary the flow of aqueous gypsum slurry discharging through the outlet in the cross machine direction.

All references cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A slurry distributor for use in a continuous manufacturing process, the slurry distributor comprising:

an entry segment defining an inlet opening;

a shaped duct in fluid communication with the inlet opening; and an outlet defining an outlet opening in fluid communication with the shaped duct;

wherein the shaped duct includes a parabolic guide surface adapted to redirect a flow of slurry moving from the inlet opening through the shaped duct to the outlet opening from an inlet direction to an outlet direction, and wherein a cross-sectional flow area of the outlet opening is in a range from greater than to 400% of a cross-sectional flow area of the inlet opening.

2. The slurry distributor of claim 1, wherein the width of the outlet opening extends along a transverse axis and a substantial portion of the parabolic guide surface is aligned with the width of the outlet opening along the transverse axis.

3. The slurry distributor of claim 1, wherein the shaped duct has a generally rectangular cross section and a generally curved outer wall that defines the parabolic guide surface such that a flow of slurry entering the slurry distributor through the inlet opening is redirected by a change in direction angle before exiting through the outlet opening.

4. The slurry distributor of claim 3, wherein the entry segment is generally cylindrical and further comprising a round-to-rectangular cross section transition segment disposed between the entry segment and the shaped duct.

5. The slurry distributor of claim 1, wherein the parabolic guide surface is at least partially defined by an outer curved wall of the duct.

6. The slurry distributor of claim 1, wherein the duct is further defined by an inner slanted wall extending at an obtuse angle relative to an outlet plane defined by the outlet opening.

7. The slurry distributor of claim 1, wherein the flow of slurry is redirected from an inlet flow direction to an outlet flow direction by a change in direction angle within a range of about forty-five degrees to about one hundred fifty degrees.

8. The slurry distributor of claim 1, further comprising:

a profiling system adapted to locally vary the shape of the opening of the outlet opening.

9. The slurry distributor of claim 1, further comprising a second inlet opening in fluid communication with the shaped duct.

10. The slurry distributor of claim 1, wherein the duct has a cross sectional flow area that increases in a direction from the inlet opening toward the outlet opening.

11. A method for providing a slurry to an advancing web, the method comprising:

passing a flow of aqueous gypsum slurry in an inlet flow direction through an inlet of a slurry distributor having a shaped duct with a parabolic guide surface such that the parabolic guide surface redirects the flow of slurry from the inlet flow direction to an outlet flow direction toward an outlet opening of the slurry distributor; and discharging the flow of the aqueous gypsum slurry from the outlet in the outlet flow direction upon an advancing web of cover sheet material, wherein a cross-sectional flow area of the outlet is in a range from greater than to 400% of a cross-sectional flow area of the inlet, and wherein the outlet flow direction of the flow of the aqueous gypsum slurry discharging from the outlet is substantially parallel to a line of travel of the advancing web of cover sheet material.

12. The method of claim 11, wherein the parabolic guide surface redirects the flow of slurry from the inlet flow direction to the outlet flow direction by a change in direction angle within a range of about forty-five degrees to about one hundred fifty degrees.

13. The method of claim 11, wherein the parabolic guide surface redirects the flow of slurry from the inlet flow direction to the outlet flow direction by a change in direction angle within a range of about eighty degrees to about one hundred degrees.

14. The method of claim 11, further comprising passing at least one additional flow of slurry through the shaped duct through a secondary inlet of the shaped duct.

15. The method of claim 11, further comprising:

adjusting the shape of the outlet opening to vary the flow of aqueous gypsum slurry discharging through the outlet.

* * * * *